United States Patent [19]

Walz

[11] 4,213,076

[45] Jul. 15, 1980

[54] CONSTANT-CURRENT TRANSFORMER FOR GAS-DISCHARGE TUBES

[76] Inventor: Alfred Walz, Am Kurzarm 7, Emmendingen, Fed. Rep. of Germany, D-7830

[21] Appl. No.: 922,238

[22] Filed: Jul. 5, 1978

[30] Foreign Application Priority Data

Mar. 23, 1978 [DE] Fed. Rep. of Germany ..... 2812757

[51] Int. Cl.[2] ..... H05B 41/16; H05B 41/233

[52] U.S. Cl. ..... 315/282; 315/239; 315/255; 315/276; 315/DIG. 5; 336/96

[58] Field of Search ..... 315/254, 255, 257, 258, 315/266, 276, 278, 282, DIG. 5, 239; 336/90, 96

[56] References Cited

U.S. PATENT DOCUMENTS

| | | | |
|---|---|---|---|
| 3,089,980 | 5/1963 | Neusbaum | 315/282 X |
| 3,116,437 | 12/1963 | Harvey | 315/282 X |
| 3,903,223 | 9/1975 | Van Der Hoek | 336/96 X |

*Primary Examiner*—Eugene P. LaRoche

*Attorney, Agent, or Firm*—Browdy and Neimark

[57] ABSTRACT

A constant current transformer for gas-discharge tubes consisting of an aluminum can containing an iron core made of grain-oriented magnetic sheet material in split-tape core form with electrically isolated primary and secondary windings. The core has gaps on opposite sides with non-magnetic spacers. Stray field yokes are provided adjacent the gaps. A series-resonance capacitor is included in the can. The active parts fit tightly against the can, which serves to carry away heat losses. The parts are impregnated in the can using an epoxy resin in an overpressure centrifuging process. The primary and secondary windings may be connected outside the transformer in a voltage-adding arrangement in series with a load. Two or more transformers may be connected with their primaries in parallel and their secondaries in parallel with a load so that their currents are added, or with their secondaries in series with a load to add their voltages. An inductance may be connected in series with the series-resonance capacitor.

13 Claims, 13 Drawing Figures

| $U_{1o}$ (V) | 100 | 140 | 180 | 200 | 220 | 230 | 240 | 250 |
|---|---|---|---|---|---|---|---|---|
| $J_{1o}$ (A) | 0.125 | 0.195 | 0.265 | 0.300 | 0.335 | 0.352 | 0.370 | 0.390 |
| Bmax (G) | 6700 | 10420 | 14150 | 16100 | 18000 | 18900 | 20000 | 21000 |
| $H_{max}$ (AW/cm) | 10.4 | 16.2 | 22.0 | 25.0 | 28.0 | 29.4 | 31.0 | 32.6 |

CONSTANT-CURRENT TRANSFORMER FOR GAS-DISCHARGE TUBES

FIELD OF THE INVENTION

This invention relates to a constant-current transformer for gas-discharge tubes with series-resonance capacitance in the secondary load circuit and with an iron core of grain-oriented magnetic sheet material, e.g., in the form of a split tape core, with electrically isolated primary and secondary windings.

SUMMARY OF THE INVENTION

The goal of the invention is to provide a constant current transformer of the type described hereinabove in such manner that the power density is increased when operating gas-discharge tubes or gas-discharge bulbs, whereby the losses are kept low.

This goal is essentially achieved by the invention by virtue of the fact that a nonmagnetic gap with a total length $\delta$ and a mean iron path length $l_m$ is disposed in the main magnetic circuit, by the fact that $\delta/l_m > 0.002$, in such manner that a maximum magnetic induction $B_{max}$ at the rated line voltage of at least 17,000 gauss is achieved in the primary winding, by the fact that the active iron and copper winding parts are completely electrically isolated in a can, preferably made of aluminum and serving primarily to conduct away heat losses, but with said active parts inserted to fit tightly against the can, by the fact that the surface of the can is at least 40% larger than the surface of the active transformer parts, and by the fact that the impregnation of the completely assembled transformer, consisting of the primary and secondary windings, the parts of the split tape core and the stray-field yokes with the gaps mounted in the main magnetic and scattered field circuits by nonmagnetic spacers is carried out after installation of the aluminum can, using an epoxy resin in an overpressure centrifuging process known of itself.

The invention provides that the necessary linear relationship between the magnetic induction B and the field strength H is made equal to 20,000 gauss by a sufficiently large iron-free gap up to $B_{max}$, without the rated power of the selected split tape core being reduced.

According to a further embodiment of the invention, it is advantageous for a magnetic stray field to be produced between the primary and secondary windings by a packet of magnetic laminations applied endwise against the split tape core, said packet consisting of preferably grain-oriented material, by the fact that the total effective iron cross section of the two stray field yokes together is greater than approximately 30% of the effective iron cross section of the main magnetic circuit, and by the fact that the magnetic induction prevailing in these yokes $B_{max}$ produced by nonmagnetic spacers between the yokes and the ends of the split tape core, is between approximately 13,000 and 14,000 gauss.

The high-pressure impregnation centrifugal technique using epoxy resin ensures that the epoxy resin damps the effects of the very high magnetostrictive forces which appear in the halves of the split tape core at a high value of $B_{max}$ and which are caused by the gap. In the constant-current transformer designed according to the invention, there is still sufficient room between the primary and secondary windings to apply a laminated stray-field yoke on each side of the split tape core to produce the necessary magnetic stray field, said yoke preferably consisting of grain-oriented magnetic laminations.

The power density which can be achieved with a constant-current transformer designed according to the invention, at least 110 VA/kp active iron and copper material at approximately 90 VA rated power, allows unusually small installation sizes, which considerably facilitate practical utilization as well as ease of installation during manufacture.

The arrangement in an aluminum can, according to the invention, ensures that the removal of heat losses from the relatively small transformer will be ensured, although the surface of the transformer is specifically small relative to its rated power. The fact that the active iron and copper winding outer surfaces are brought into good thermal contact with the metal surfaces of the aluminium can while maintaining conventional insulation requirements keeps the continuous duty temperature below the permissible limit (maximum excess temperature 75°). The maximum excess temperature $\Delta t$ of the transformer windings can be kept at approximately 45° C. with the rated continuous duty load. The limiting value established by the technical specifications for the maximum winding excess temperature is 75° C. for Class F enameled wire.

According to another embodiment of the invention it is advantageous for a series resonance capacitor to be connected in the free space in the aluminum can and preferably to be sealed moisture-tight together with the parts of the transformer.

In this manner, a power density of approximately 70 VA/kp is achieved even for a complete unit including the series resonance capacitor and including the impregnating and potting compound, in a device with approximately 90 VA continuous duty power rating, i.e., a weight of approximately 1.3 kp for 90 VA.

In an advantageous embodiment of the invention, two or more transformers are connected so that their primaries are in parallel and their secondaries are connected in parallel to add their currents, and then connected to a load.

According to a modified embodiment of the invention, two or more transformers have their primaries connected in parallel and their secondaries connected in a voltage-adding manner in series with a load.

According to another embodiment of the invention, the primary and secondary windings outside the transformer are connected in series with a load in an economy circuit so that their voltages are added.

In order to increase the light yield of gas-discharge tubes or gas-discharge bulbs attached to the circuit, and to keep the losses low or to reduce them, it is advantageous according to another embodiment of the invention for an inductance to be connected in series with the series resonance capacitor. In this manner, the zero current time is advantageously shortened. By adding the inductance in series with the series resonance capacitor, the constant current behavior of the circuit is not changed.

According to another feature of the invention, it is especially advantageous if the inductance consists of a winding of copper wire on a split-tape core. This results in reduction of weight and losses while keeping inductance the same. This additional inductance reduces the harmonics, so that the current nearly describes a sine wave, producing at least a 10% higher light yield.

BRIEF DESCRIPTION OF THE DRAWINGS

Further advantages and features of the drawing will be described in greater detail with reference to the drawings, wherein.

DESCRIPTION OF THE PREFERRED EMBODIMENTS

Figure 1:
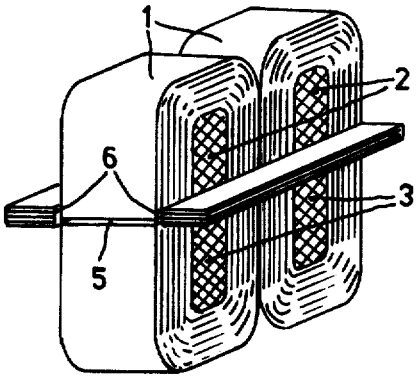
FIG. 1 is an embodiment of a constant-current transformer according to the invention in an oblique view.
Figure 2:
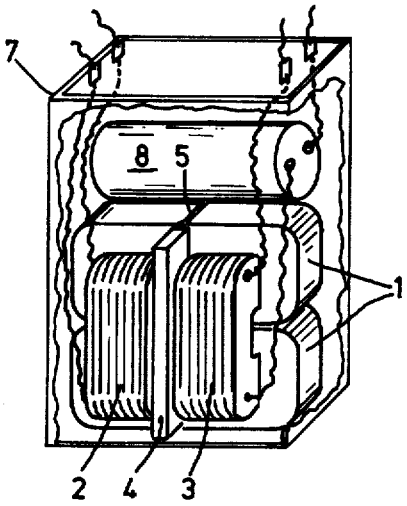
FIG. 2 is a perspective view of a partly exposed completely assembled transformer with a resonance capacitance.

FIGS. 1 and 2 show a constant-current transformer for 90 VA according to the invention, with approximately 90 mA full-load current and 990 V zero-load voltage. A split-tape core made of two loops of Type SU 39*b* is provided, wherein the weight is $2\times0.254=0.508$ kp, the effective iron cross section $q_{Fe}=4.48$ cm$^2$, and the mean iron path length is $l_{Fe}=14.8$ cm. Windings 2 and 3 consist of enameled copper wire, Class F or Class H, and primary winding 2 consists of wire with a diameter $d_1=0.38$ mm with a copper cross section $q_{Cu1}=0.1135$ mm$^2$, with an average winding turn length $l_1=14.8$ cm and a winding number $w_1=1230$. The ohmic resistance $R_1$ is then 26.50 ohms. A wire with a diameter $d_2=0.16$ mm is used for secondary winding 3, whereby the copper cross section $q_{Cu2}=0.0201$ mm$^2$, the average winding turn length $l_2=l_1=14.8$ cm, and the winding number $W_2=6300$. In the secondary winding, the ohmic resistance $R_2$ is 760 ohms. The series resonance capacitance C provided is selected to be 0.21$\mu$F to 0.23$\mu$F. Operating voltage $U_C=1100$ V rms. The electromagnetic characteristics of the transformer according to the invention are as follows:

For the rms value of the AC voltage in the transformer windings, the familiar transformer formula is valid:

$$U\ \text{rms}=4.44\times f_r x w\times\phi_{max}\times10^{-8}\ \text{V}$$

with $f_r$=the line frequency=50 Hz, w=the winding number, magnetic flux $\phi=q_{Fe}\times B_{max}$; $B_{max}$ is the maximum value of the induction. When the line voltage $U_N$ rms=220 V is applied to primary winding 2, an induction $B_{max}=18{,}000$ gauss is produced in iron core 2. The required excitation according to FIG. 3, Curve 1, is approximately 28.0 ampere windings per cm (AW/cm=H). For $l_{Fe}=14.8$ cm, the zeroload current $I_{10}=0.335$ A.

Figure 3:
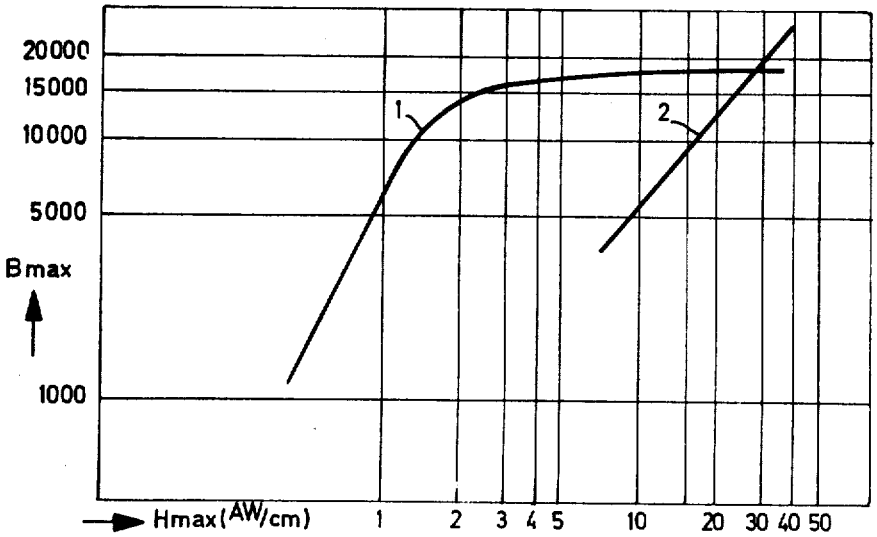
FIG. 3 is a family of characteristics.

The practically linear curve of $B_{max}$ ($H_{max}$) which is to be provided according to the invention is demonstrated on the basis of the measurement results shown in Table 1 and Curve 2, FIG. 3. Curve 1 is for a ring core made of the same grain-oriented material, but without gap 5 (FIG. 1). Gap 5, in the split-tape core SU 39*b* according to the invention, is approximately $2\times0.25$ mm=0.5 mm. It is manufactured and adjusted by means of a nonmagnetic electrically nonconducting spacer, e.g., made of pressboard. Then the required relationship $B_{max}$ ($H_{max}$) is provided by Curve 2, FIG. 3.

The primary current $I_1$ at full load $I_2=0.090$ A, $U_2=990$ V, (Consumer power $P_2=90$ VA) was measured at 0.46 A. The power draw from the line is then $P_1=P_2+P_v$. $P_v$ is the sum of the copper and iron losses. We will then have $$P_v=P_{v1}+P_{v2}+P_{vFe}\ \text{and}$$

$$P_{v1}=I_1^2\times R_1=0.46^2\times25.5=5.4\ W.$$

$$P_{v2}=I_2^2 s R_2=0.090^2\times720=5.9\ W.$$

$$P_{vFe}=1\text{W; then}$$

$$P_v=12.3\ W\ \text{and}\ P_1=102.3\ W=U_N\times I_1=220\times0.465.$$

Under full load, cos $\phi=1$ (resonance with capacitance 8).

Then the efficiency of the transformer at full load will be:

$$\eta_{max}=90/(90+12.3)=0.88.$$

For the split-tape core, a material is used with a maximum loss of 2.2 W/kp at an induction $B_{max}=17{,}000$ gauss. A laminated stray field yoke 4 is inserted between primary and secondary windings 2 and 3 to produce the necessary magnetic stray field on each side of split-tape core 1. A gap 6 between stray-field yoke 4 and the ends of split-tape core 1 is selected to be between 0.5 mm and 1.5 mm. The transformer windings and the cores with the yokes are tightly encased in an aluminum can 7, as shown in FIG. 2. The external dimensions of aluminum can 7, in one embodiment, were $45\times70\times125$ mm. The interior of aluminum can 7, which is employed in this design primarily for purposes of carrying away the heat, is sufficient to accept capacitor 8, together with the volume dictated by the rated current and voltage.

Figure 4:
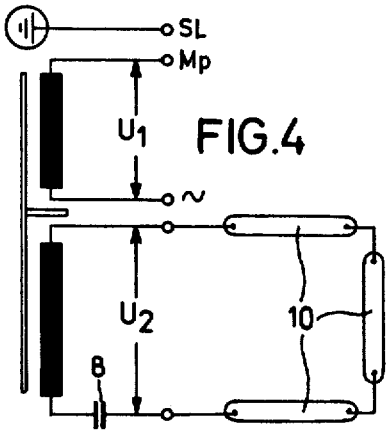
FIG. 4 is a schematic diagram of one embodiment.
Figure 5:
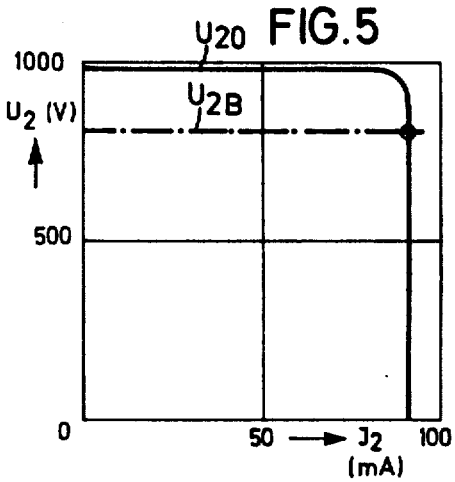
FIG. 5 is a characteristic for the circuit shown in FIG. 4.

A circuit using fluorescent tubes 10 is shown in FIG. 4. The primary and secondary windings 2 and 3 of the transformer according to the invention shown schematically in FIGS. 1 and 2 are electrically isolated and completely insulated according to the regulations from one another and from the split-tape core 1 and aluminum can 7. The fluorescent tubes 10 are the secondary load circuit of the transformer. The $I_2$ tolerance between the full load and the short circuit is about ±5%. The maximum usable operating voltage $U_{2B}$ with rated constant current $I_2$ is normally about 0.8 $U_{20}$. Owing to the constancy of the current, the devices can be connected in parallel on the secondary side to multiply the secondary current, and a series arrangement is possible to multiply the secondary voltage. Thus, using a single type of device, a modular system can be built up for any application.

Figure 6:
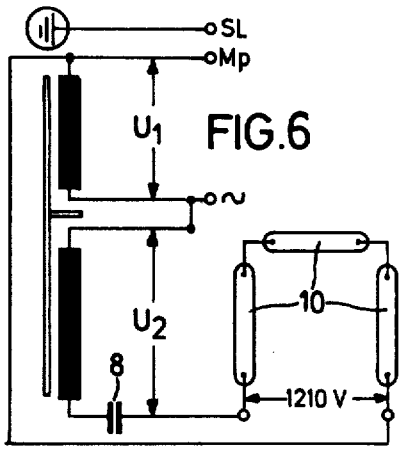
FIG. 6 is an economy circuit.
Figure 7:
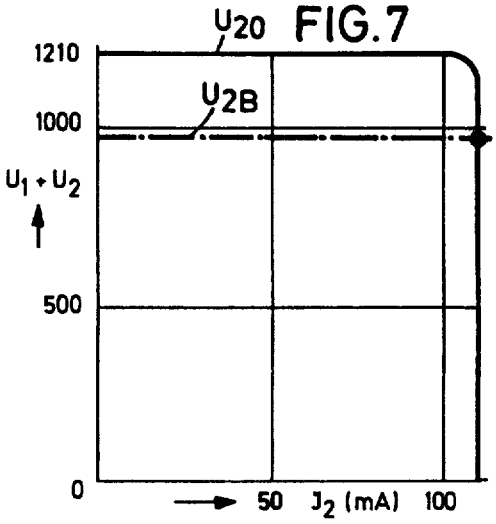
FIG. 7 is a characteristic for FIG. 6.

Another economy circuit is shown in FIG. 6, whereby characteristic $U_2$ ($I_2$) is shown in FIG. 7. In this circuit, without making any changes to the internal construction of the transformer, the constant current $I_2$ and the rated power can be made about 20% higher. The maximum excess temperature of the windings then increases by about 10° C. to approximately t=55° C. This economy circuit also improves the ignition reliability of the fluorescent tubes, especially when cold.

Figure 8:
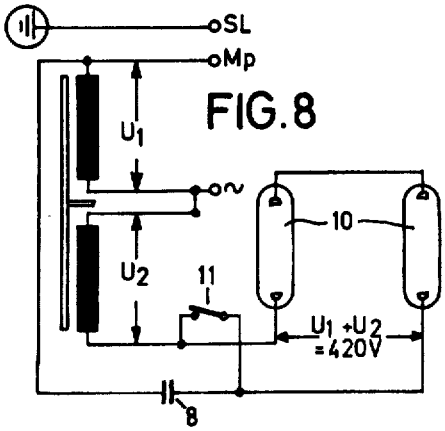
FIG. 8 is another economy circuit.
Figure 9:
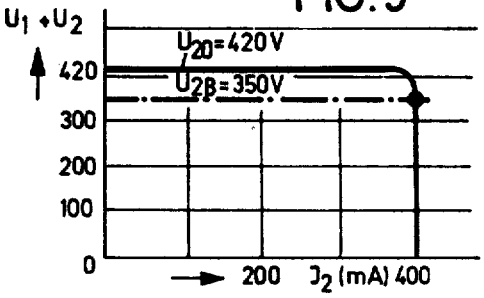
FIG. 9 is a characteristic for the circuit in FIG. 8.

A maximum power density VA/kp is achieved with the same amount of active iron and copper in the constant current transformer described as an example, if the secondary winding 3 is made with the same winding number and the same Cu wire thickness ($w_2=w_1=1230$ turns, $d_2=d_1=0.38$ mm) and used in the economy circuit according to FIG. 8. The no-load voltage on the secondary will then be $U_1+U_2=420$ V, and, with a series resonance capacitance 8 of 2 to 3 μF a constant current of approximately 0.4 to 0.5 A results. According to the appropriate characteristic $U_1+U_2=f(I_2)$ according to FIG. 9, gas-discharge tube systems (fluorescent tubes) with a conducting voltage requirement between 350 and 300 V can be operated in accordance with a power consumption $P_2=0.43\times350=0.50\times300=150$ VA. Hence, three fluorescent lamps can be connected in series, with standard dimensions (length 1.2 m, tube diameter D=37 mm), or two fluorescent lamps can be made to burn at a steady current in a series circuit with standard dimensions (length 1.8, tube diameter $D=37$ mm), as shown in FIG. 9. Ignition is performed according to the invention using a voltage induction pulse, produced by a stray magnetic flux change in the transformer when a short circuit home contact 11 according to FIG. 8 connected in parallel to the series-connected tubes, opens. The opening of the contact can be accomplished in a known fashion by electromechanical means (with a relay), with a cathode igniter or electronically with a thyristor preferably at the maximum of the current halfwave.

In this type of operation, the excess temperature of the transformer windings reaches values of $\Delta t=72°$ C., which therefore approach the limit value $\Delta t=75°$ C.

The resonance capacitance C of 2 to 3 μF in this case is advantageously disposed outside aluminum can 7.

Figure 10:
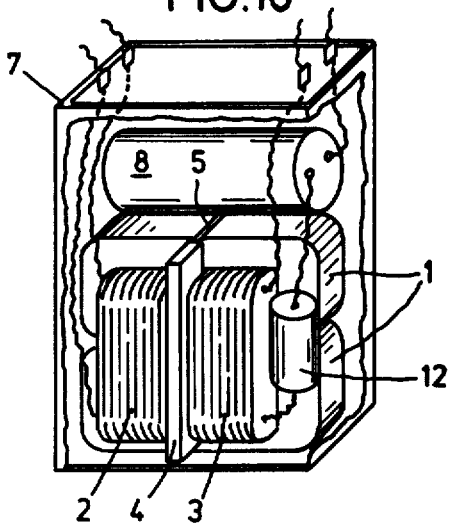
FIG. 10 is a partly exposed perspective view of the arrangement of an inductance according to the invention with a transformer according to FIG. 2.

The constant-current transformer shown in FIG. 10 corresponds in its design essentially to the transformer according to FIG. 2. A split-tape core 1 with windings 2 and 3 is provided, whereby series resonance capacitor 8 is disposed in aluminum can 7. An inductance 12 is connected in series with series resonance capacitor 8.

Figure 11:
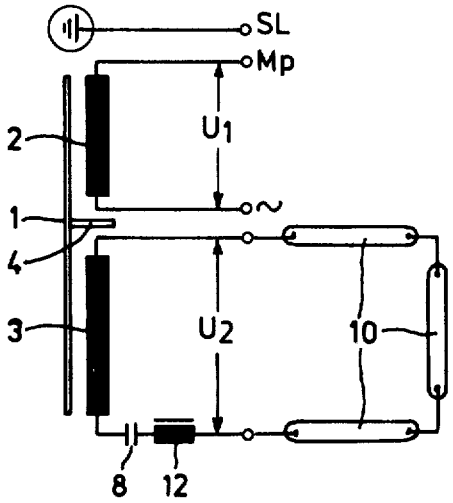
FIGS. 11, 12 and 13 are circuit diagrams of embodiments according to FIG. 10, combined with circuits from FIGS. 4 and 6 or 8.

In the embodiment according to FIG. 11, fluorescent tubes 10 are indicated. Primary and secondary windings 2 and 3 of the transformer are electrically isolated and completely insulated from one another as well as from the split-tape core 1 and aluminum can 7. Fluorescent tubes 10 are connected to the secondary load circuit of the transformer. A series resonance capacitor 8 is connected in series with winding 3, and inductance 12 is connected in series with the latter.

Figure 12:
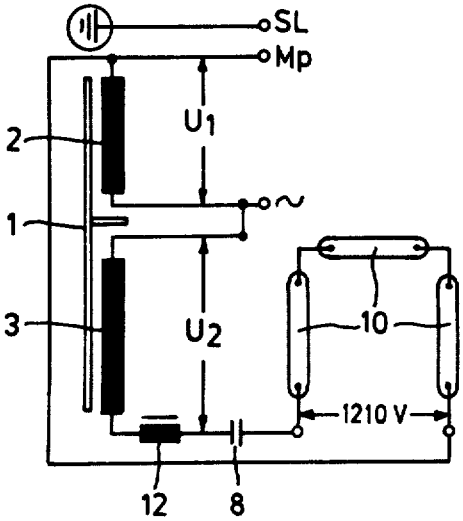

In the embodiment according to FIG. 12, which shows an economy circuit, additional inductance 12 is shown between winding 3 and capacitor 8, corresponding to the drawing in FIG. 10.

Figure 13:
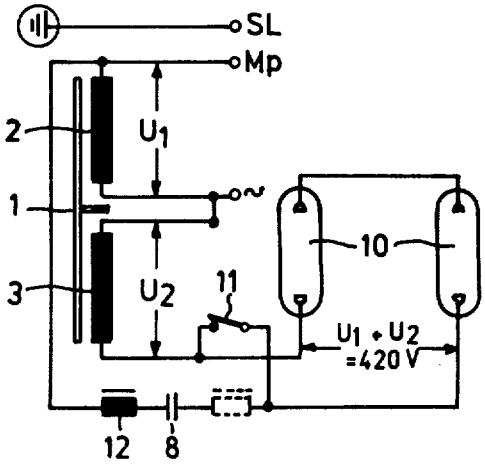

According to another economy circuit shown in FIG. 13, which corresponds to FIG. 8, inductance 12 can be provided between series resonance capacitor 8 and winding 2, and also between series resonance capacitor 8 and short circuit home contact 11.

By adding inductance 12 in series with capacitor 8, the constant-current behavior of the circuit is not changed. On the other hand, the zero-current time and the percentage of harmonics are reduced.

In the embodiment shown in FIG. 10, inductance 12 is not shown with its true shape and size. In the normal case, the dimensions of inductance 12 correspond approximately to those of a 40 W ballast, measuring approximately 42×42×50 mm. When such an inductance 12 is used, it may be advantageous to dispose capacitor 8 outside can 7. Otherwise, there is the possibility of installing inductance 12 outside can 7. Finally, both capacitor 8 and inductance 12, possibly combined in an additional housing, can be mounted separately from can 7 or the transformer.

The invention is not limited to the embodiments shown and described. It also includes all improvements made by an individual skilled in the art and modifications as well as uses and all partial and subcombinations of the features and devices described and/or shown.

What is claimed is:

1. In a constant-current transformer for gas-discharge tubes with a series-resonance capacitor in a secondary load circuit and provided with an iron core made of grain-oriented magnetic sheet material, with electrically isolated primary and secondary windings, the improvement wherein at least one nonmagnetic gap with a total length δ and a mean iron path length $\mathbf{1}_m$ is provided in a main magnetic circuit, with at least two stray-field yokes adjacent said gap, $\delta/\mathbf{1}_m>0.002$, a maximum magnetic induction $B_{max}$ of at least 17,000 gauss is achieved with rated line voltage on said primary winding, and including means for completely electrically isolating active iron and copper winding parts, a heat-conductive can surrounding said windings and said core which serves primarily to carry away heat losses, said parts being installed in said can tightly pressing against the latter, wherein the surface of said can is at least 40% greater than the surface of the active transformer parts, and wherein impregnation of the completely assembled transformer, consisting at least of said primary and secondary windings, said core and said stray-field yokes, with said gap being determined by a nonmagnetic spacer in the main magnetic and stray-field circuits, is carried out following installation in said can using an epoxy resin in an overpressure centrifuging process.

2. An improved constant-current transformer according to claim 1, wherein said stray-field yokes are between said primary and secondary windings and comprise two respective magnetic lamination packets applied endwise against said core,, wherein the total effective iron cross section of said two stray-field yokes taken together is greater than approximately 30% of the effective iron cross section of the main magnetic circuit, and wherein the magnetic induction prevailing in these yokes is adjusted by means of respective nonmagnetic spacers between said yokes and ends of said core to $B_{max}$ between approximately 13,000 and 14,000 gauss.

3. An improved constant-current transformer according to claim 2, wherein said core is a split-tape core.

4. An improved constant-current transformer according to claim 1, wherein said series resonance capacitor is disposed in free space available in said can.

5. An improved constant-current transformer according to claim 4, wherein said can is of aluminum.

6. An improved constant-current transformer according to claim 4, wherein said series resonance capacitor is installed in a moisture-tight fashion with the active transformer parts within said can.

7. An improved constant-current transformer according to claim 1, including an inductance connected in series with said series-resonance capacitor.

8. An improved constant-current transformer according to claim 7, wherein said core is a split-tape core and said inductance consists of a winding of copper wires upon a split-tape core.

9. An improved constant-current transformer according to claim 1, wherein said iron core is in split-tape core form.

10. An improved constant-current transformer according to claim 1, wherein said can is made of aluminum.

11. An improved constant-current transformer according to claim 1, in operative association with at least one more transformer of substantially identical construction, said transformers being connected with their primaries in parallel and their secondaries in parallel with a load, so that their currents are added.

12. An improved constant-current transformer according to claim 1, in operative association with at least one more transformer of substantially identical construction, said transformers having their primaries connected in parallel and their secondaries connected in series with a load to add their voltages.

13. An improved constant-current transformer according to claim 1, wherein said primary and secondary windings are connected outside the transformer in an economy circuit in a voltage-adding arrangement in series with a load.

* * * * *